US005607246A

United States Patent [19]

Podosek

[11] Patent Number: 5,607,246

[45] Date of Patent: Mar. 4, 1997

[54] RING BINDER

[75] Inventor: Edward Podosek, Wilbraham, Mass.

[73] Assignee: Avery Dennison Corporation, Pasadena, Calif.

[21] Appl. No.: 296,816

[22] Filed: Aug. 26, 1994

Related U.S. Application Data

[63] Continuation-in-part of PCT/US93/03786 Apr. 21, 1993.

[51] Int. Cl.[6] ..... B42F 13/00

[52] U.S. Cl. ..... 402/73; 402/76; 402/502; 402/80 R; 281/29; 281/18; 281/36

[58] Field of Search ..... 281/18, 29, 36; 402/73, 75–77, 80 R, 502; 412/3, 17

[56] References Cited

U.S. PATENT DOCUMENTS

| | | | |
|---|---|---|---|
| 529,614 | 11/1894 | Frith . | |
| 3,572,957 | 3/1971 | Strassberg . | |
| 4,600,346 | 7/1986 | Podosek | 281/35 X |
| 4,630,843 | 12/1986 | Willat | 402/75 X |
| 5,020,828 | 6/1991 | Moor | 281/36 X |
| 5,104,147 | 4/1992 | King | 281/21.1 |
| 5,213,368 | 5/1993 | Wyant | 281/18 |
| 5,222,826 | 6/1993 | Wyant | 281/29 X |

*Primary Examiner*—Frances Han
*Attorney, Agent, or Firm*—Kriegsman & Kriegsman

[57] ABSTRACT

A ring binder which is easy to grasp at the spine and is capable of accommodating a great number of loose-leaf sheet. According to one embodiment, such a ring binder comprises a stiffener assembly, the stiffener assembly having an interior surface and an exterior surface and comprising a front cover stiffener panel, a rear cover stiffener panel and a flexible backing. The front and rear cover stiffener panels are spaced apart from one another and are interconnected by the flexible backing, the stiffener assembly being devoid of any stiffeners disposed between the front and rear cover stiffener panels. An interior surface sheet, preferably of canvas material, is secured to the interior surface of the stiffener assembly, and an exterior surface sheet, preferably of canvas material, is secured to the exterior surface of the stiffener assembly. A ring assembly is secured to the rear cover stiffener panel. In this manner, the surface sheets and the stiffener assembly cooperatively define a binder cover having front and rear covers interconnected by a flexible spine, the flexible spine being conformable about the ring assembly.

16 Claims, 7 Drawing Sheets

RING BINDER

The present application is a continuation-in-part of presently-pending PCT application No. PCT/US93/03786, which was filed Apr. 21, 1993.

BACKGROUND OF THE INVENTION

The present invention relates generally to ring binders and more particularly to a novel ring binder.

Referring to FIG. 1, a side view, broken away in part, of one type of prior art ring binder 11 is illustrated. Binder 11 comprises a pair of superimposed sheets 13-1 and 13-2 of thermoplastic material, preferably vinyl, and three rigid, spaced-apart, stiffener panels 15-1, 15-2 and 15-3, respectively. Stiffener panels 15-1 through 15-3, which are appropriately sized to provide support to the rear cover, spine and front cover, respectively, of binder 11, are sandwiched between sheets 13-1 and 13-2. Sheets 13-1 and 13-2 are heat-sealed to one another around their respective peripheries and on either side of panel 15-2 to define the rear cover 17-1, spine 17-2, and front cover 17-3, respectively, of binder 11, spine 17-2 being joined to rear cover 17-1 and to front cover 17-3 by hinge lines 19-1 and 19-2, respectively. A snap-ring assembly 21 is riveted or otherwise fastened directly to rear cover 17-1. Spine 17-2 is free to pivot away from ring assembly 21 in the direction indicated by arrow 22 to provide convenient access to assembly 21. As can be seen, the width of spine 17-2 is great enough to enable covers 17-1 and 17-3 to clear the snap rings of assembly 21. This type of binder is particularly well-suited to uses requiring oversized snap rings for maintaining a great number of loose-leaf sheets. Such a binder, however, requires excessive shelf space, and it is difficult to grasp at the wide, flat and pivotable spine 17-2.

In U.S. Pat. No. 5,222,825, inventor Wyant, which issued Jun. 29, 1993 and which is incorporated herein by reference, there is disclosed a round back binder which is directed to overcoming some of the problems mentioned above. More specifically, the binder disclosed therein comprises a rectangular stiffener board and a sheet retaining assembly. The stiffener board is provided in its first surface with at least three spaced parallel partially-penetrating channels medially located between the side edges of the board. Each channel defines a hinge line extending along the height of the stiffener board. The sheet retaining assembly is mounted on the first surface of the board adjacent to the channels but outside the medial section of the board where the channels are located. The binder, thus structured, allows the stiffener board to define front and rear covers of the binder interconnected by the medial section which is foldable conformingly about the retaining assembly. The stiffener board may be covered by a pair of surface sheets, preferably fabricated from canvas material. One of the surface sheets, the interior surface sheet, is secured to the channeled surface of the stiffener board by adhesive material. The adhesive may be distributed so as to cause the interior surface sheet to extend conformingly into the channels. This interior surface sheet faces inwardly in the assembled binder. A second sheet, the exterior surface sheet, preferably also canvas, covers the opposite surface of the stiffener, extends around the edges thereof and is bonded against the interior surface of the interior surface sheet.

In PCT application No. PCT/US93/03786, which was filed Apr. 21, 1993 and which is incorporated herein by reference, there is disclosed another example of a ring binder having a curvable spine. More specifically, the ring binder disclosed therein includes two rectangular polymeric sheets of sufficient size to form the entire inner and outer covering of the binder. Disposed between the sheets is a semi-rigid rectangular insert. The insert is formed or machined with two parallel partially-penetrating hinge grooves which divide the insert into three zones. The front zone and back zone are dimensioned to be approximately the same length and width as the cover panels of the binder. The spine zone is dimensioned to be approximately the same length and width as the spine. A plurality of parallel partially-penetrating spine grooves are provided between the hinge grooves on the insert. The spine grooves act like the hinge grooves and allow the spine to transform from a flat configuration to a curved configuration in which the inner surface of the spine is concave about the longitudinal axis of the spine. The spacing and number of spine grooves is selected to result in a smooth curve on the outside surface of the spine when the binder is closed. The ring hardware is preferably mounted, by conventional rivets and holes, to one or the other of the covers, rather than to the spine.

In U.S. Pat. No. 4,856,817, inventor Moor, which issued Aug. 15, 1989 and which is incorporated herein by reference, there is disclosed an easy-grip binder having opposed spine recesses for ease of grasping. More specifically, the binder disclosed therein comprises a front cover board, a rear cover board and a spine board positioned between the front cover board and the rear cover board so as to define front and rear hinge lines therebetween. Inside and outside cover sheets are laminated to the spine board and cover boards on opposite sides in the customary manner. The spine recesses are defined by cutouts on opposite sides of the spine board and matching cutouts on the cover boards. The outside cover sheet is depressed conformingly into the cutouts. A hand-hold recess is provided opposite the spine recesses. This latter recess is defined by providing hand-hold cutouts along the edges of the cover boards which are remote from the spine. The inside and outside covers are conformingly fitted into these cutouts. Preferably, the outside cover sheet has a ribbed contour in the region of the spine recesses to facilitate finger gripping.

In U.S. Pat. No. 5,219,437, inventors Moor et al., which issued Jun. 15, 1993 and which is incorporated herein by reference, there is disclosed a fabric covered book cover. More specifically, the book cover disclosed therein comprises an inside fabric surface adjacent the contents of the book cover and an outside fabric surface opposite the inside surface which comes into contact with the hand when the book cover is carried. In a more preferred embodiment, the fabric material is woven nylon or another synthetic material. The book cover includes two leafboards which are rectangular and formed by first and second stiffening members, each stiffening member when incorporated into the book cover has three outside edges which form the periphery of the cover and one internal edge. The fabric encases the stiffening members which are spaced apart on the fabric. A peripheral seam is located along and immediately outside the outside edges of the stiffening members. A pair of parallel and spaced seams running along and immediately adjacent the internal edges of the stiffening members maintain the position of both stiffening members within the fabric. In a more preferred embodiment, the stiffening member is cardboard, pressed paper or the like. In a more preferred embodiment, a padding member can be positioned between the stiffening member and the fabric in each of the front and back leafboards. The spine is formed by a portion of fabric which connects the front and back leafboards. The spine includes a plurality of parallel longitudinal seams which enable the spine to curl flexibly such that it is easily cupped in the palm of the hand. In a more preferred embodiment, the spine has a padding member encased therein and the plurality of seams maintain a constant amount of the padding material between each parallel stitched seam and thus prevent the padding member from accumulating unevenly in the spine.

In U.S. Pat. No. 3,572,957, inventor Strassberg, which issued Mar. 30, 1971 and which is incorporated herein by reference, there is disclosed a ribbed-backbone binder construction for use in a looseleaf binder. More specifically, the binder construction disclosed therein comprises a single unit board stiffener which includes front and rear cover sections and a backbone section having elongated openings, running almost the entire width of the stiffener and positioned on both sides of a center strip, forming an element of the support strip for the ring mechanism. The stiffener is completely covered by sheets of thermoplastic material which are welded around the edges and through the elongated openings of the stiffener. A typical snap ring mechanism may then be riveted into position against the support strip formed by the cover sheets and the stiffener, and the elongated openings and the material therebetween form a plurality of ribs and hinges which may be folded around the ring mechanism. The ribs and hinges may then be expanded beyond the widths of the support strip as there is increased capacity within the binder. The ribbed and hinged portion may also be gripped by the hand, the hinges allowing the covers to lie completely flat.

SUMMARY OF THE INVENTION

It is an object of the present invention to provide a novel ring binder.

It is another object of the present invention to provide a ring binder which is capable of accommodating a great number of loose-leaf sheets, yet is easy to grasp at the spine.

It is still another object of the present invention to provide a ring binder as described above which can be fabricated easily and which can be mass produced.

In furtherance of the foregoing and other objects to be described or to become apparent below, a ring binder constructed in accordance with the teachings of the present invention comprises in a first embodiment (a) a stiffener assembly, said stiffener assembly having an interior surface and an exterior surface and comprising a front cover stiffener panel, a rear cover stiffener panel and a flexible backing, said front cover stiffener panel and said rear cover stiffener panel being spaced apart from one another and being interconnected by said flexible backing, said stiffener assembly being devoid of any stiffeners disposed between said front cover stiffener panel and said rear cover stiffener panel; (b) an interior surface sheet secured to the interior surface of said stiffener assembly; (c) an exterior surface sheet secured to the exterior surface of said stiffener assembly; and (d) a ring assembly secured to one of said front cover stiffener panel and said rear cover stiffener panel; (e) whereby said surface sheets and said stiffener assembly cooperatively define a binder cover having front and rear covers interconnected by a flexible spine, said flexible spine being conformable about said ring assembly.

According to a second embodiment, a ring binder constructed in accordance with the teachings of the present invention comprises (a) an inside surface sheet; (b) an outside surface sheet; (c) a front cover stiffener panel, said front cover stiffener panel being secured between said inside and said outside surface sheets; (d) a rear cover stiffener panel, said rear cover stiffener panel being spaced apart from said front cover stiffener panel in parallel relation thereto and being secured between said inside and said outside surface sheets; (e) a plurality of stiffener strips, said stiffener strips being spaced apart and positioned between said front and rear cover stiffener panels in parallel relation thereto, said stiffener strips being secured between said inside and said outside surface sheets and forming therebetween at least one completely penetrating channel; and (f) a ring assembly secured to one of said front cover stiffener panel and said rear cover stiffener panel; (g) whereby said inside and said outside surface sheets, said front and said rear cover stiffener panels, and said stiffener strips cooperatively define a binder cover having front and rear covers interconnected by a foldable spine, said foldable spine being conformable about said ring assembly.

According to a third embodiment, a ring binder constructed in accordance with the teachings of the present invention comprises (a) a front cover stiffener panel; (b) a rear cover stiffener panel, said rear cover stiffener panel being spaced apart from said front cover stiffener panel in parallel relation thereto; (c) a pair of heat-sealable thermoplastic sheets, said heat-sealable thermoplastic sheets being disposed on opposite sides of said front and rear cover stiffener panels and being heat-sealed to one another around their respective peripheries and along at least three seams extending between opposing peripheries of said heat-sealable thermoplastic sheets and located between said front and rear cover stiffener panels and in parallel relation thereto, each adjacent pair of said seams together with the adjacent portions of the respective peripheries of said heat-sealable thermoplastic sheets forming a chamber, each of said chambers being inflated with air; and (d) a ring assembly secured to one of said front cover stiffener panel and said rear cover stiffener panel; (e) whereby said heat-sealable thermoplastic sheets and said front and said rear cover stiffener panels cooperatively define a binder cover having front and rear covers interconnected by a foldable spine comprising said inflated chambers, said foldable spine being conformable about said ring assembly.

Additional objects, features and advantages of the present invention will be set forth in part in the description which follows, and in part will be obvious from the description or may be learned by practice of the invention. These embodiments will be described in sufficient detail to enable those skilled in the art to practice the invention, and it is to be understood that other embodiments may be utilized and that changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
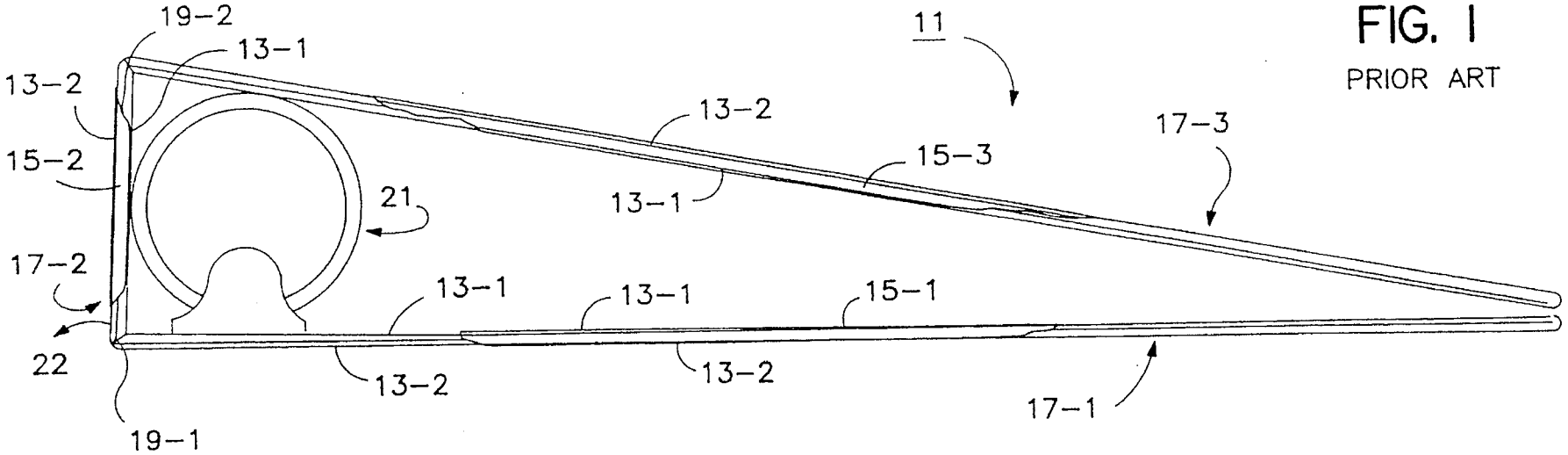
FIG. 1 PRIOR ART
FIG. 1 is a side view, broken away in part, of one type of prior art ring binder.
Figure 2:
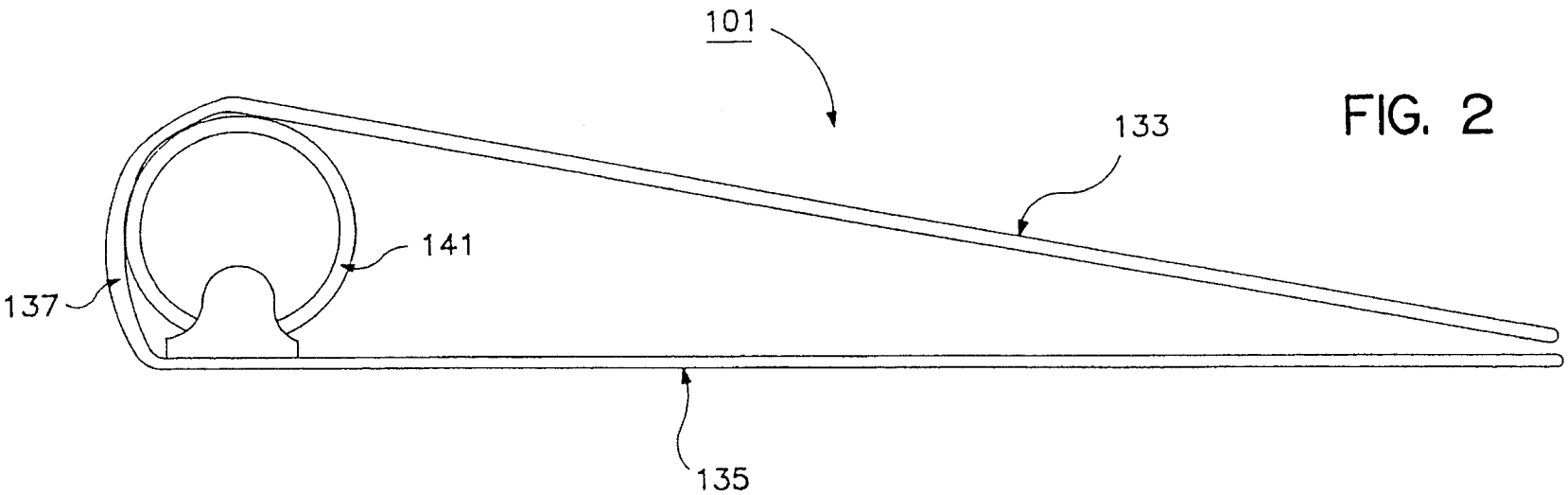
FIG. 2 is a side view of a first embodiment of a ring binder constructed according to the teachings of the present invention.
Figure 3:
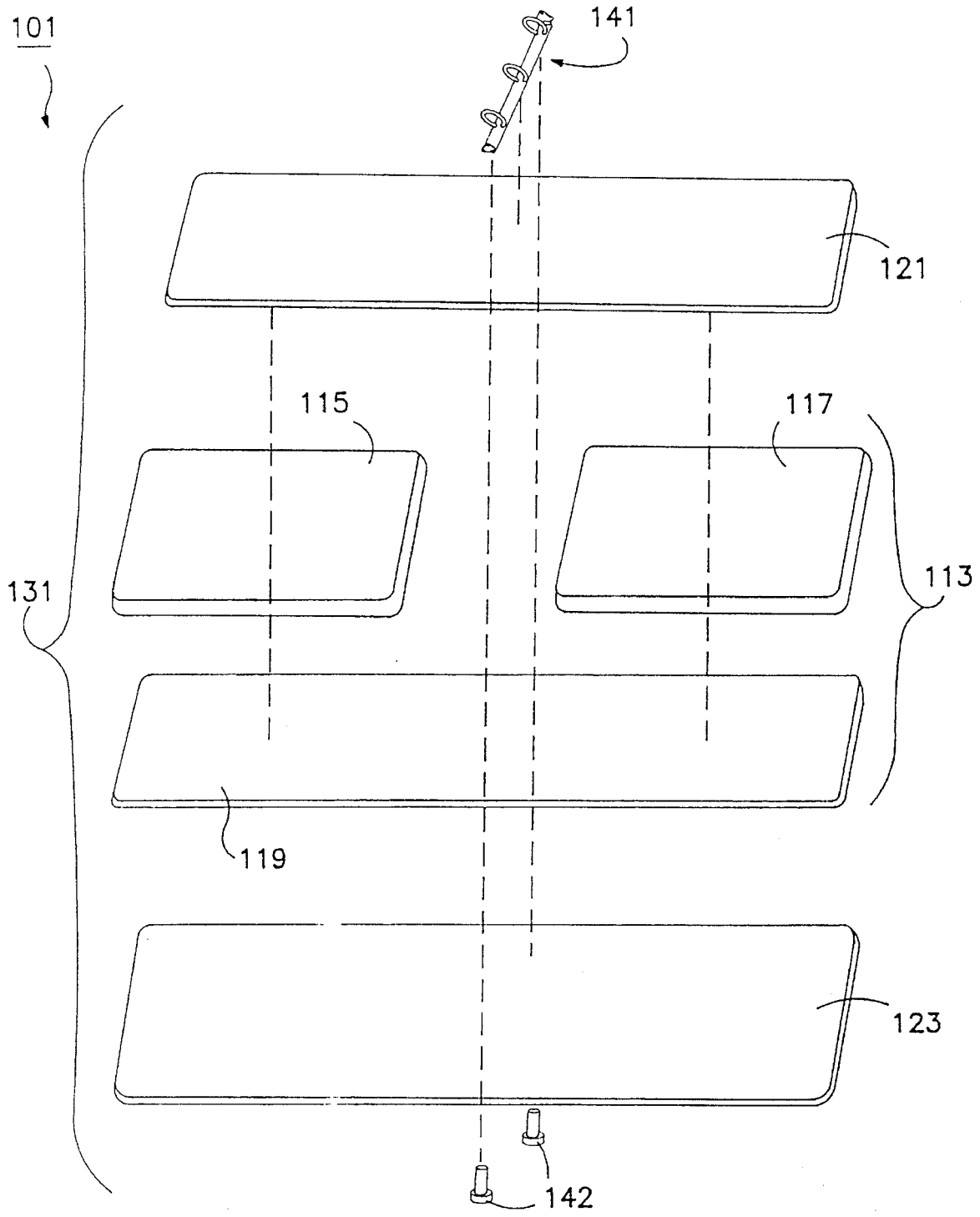
FIG. 3 is a partially exploded perspective view of the components of the ring binder shown in FIG. 2, prior to their assembly.
Figure 4:
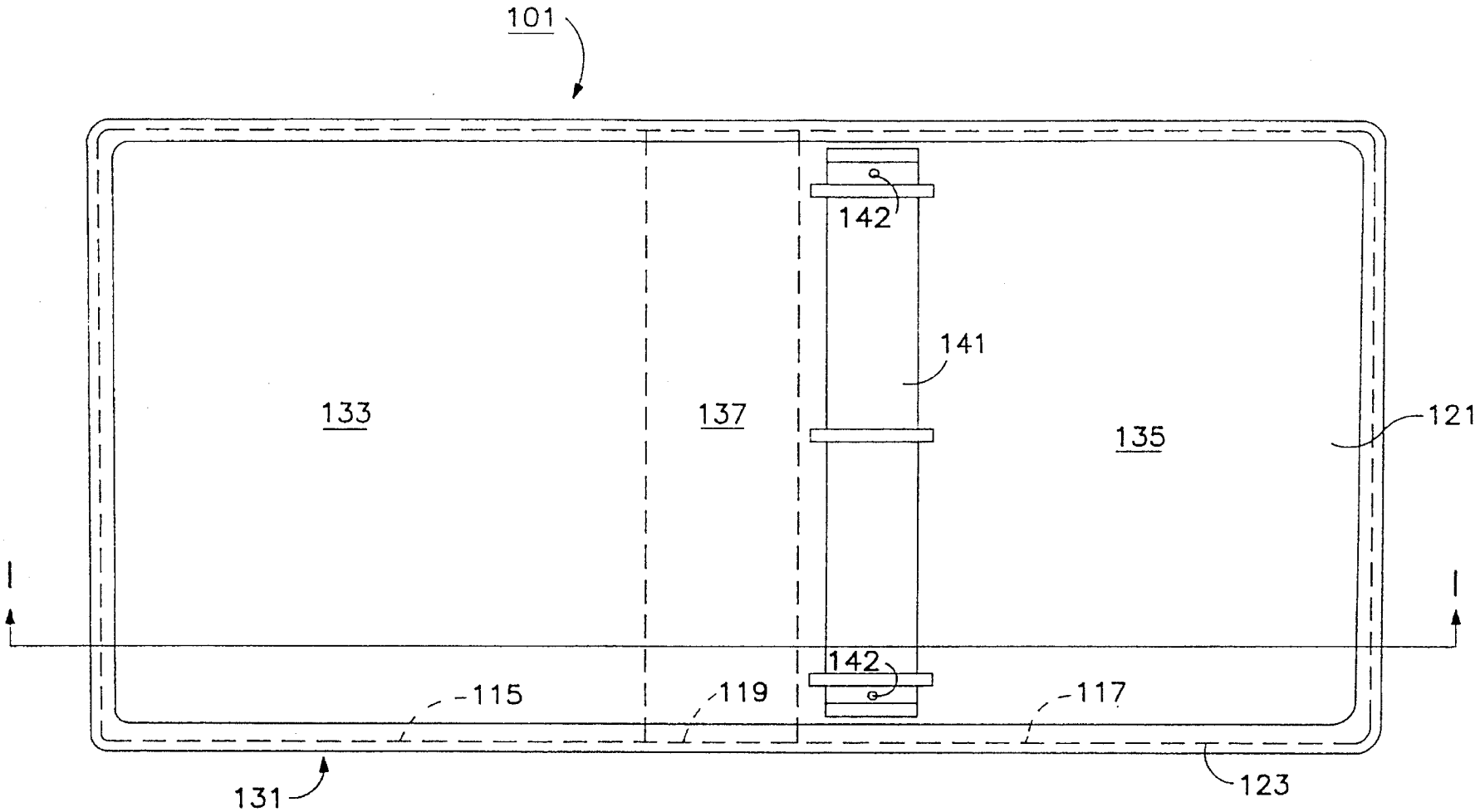
FIG. 4 is a plan view of the ring binder shown in FIG. 2, the ring binder being shown in an opened condition.
Figure 5:
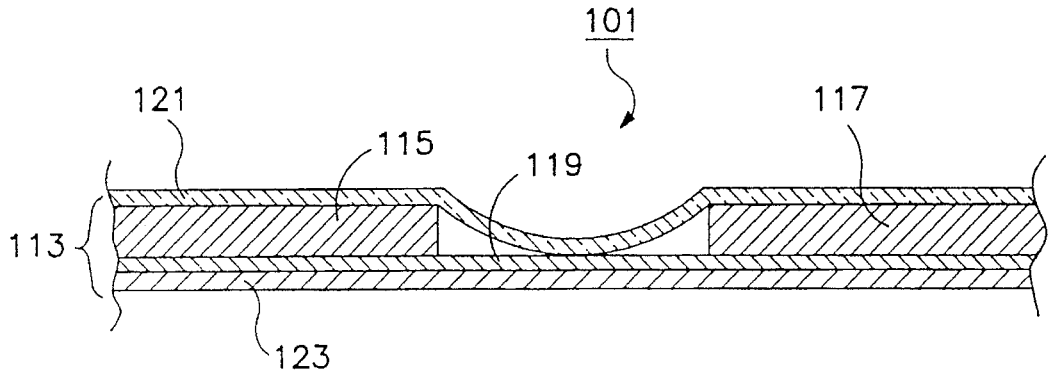
FIG. 5 is a fragmentary section view taken along line 1—1 in FIG. 4, the ring assembly not being shown for simplicity.

Referring now to FIGS. 2 through 5, there are shown various views of a first embodiment of a ring binder constructed according to the teachings of the present invention, the ring binder being represented generally by reference numeral 101.

Binder 101 includes a stiffener assembly 113. Stiffener assembly 113 includes a front cover stiffener panel 115, a rear cover stiffener panel 117 and a backing sheet 119. Front cover stiffener panel 115 and rear cover stiffener panel 117 are rectangular in shape and are sized to approximate the front cover and rear cover, respectively, of binder 101. Panels 115 and 117 are made from a rigid material, such as chipboard (e.g., 110 pt.), cardboard, paperboard or the like. Backing sheet 119, which is a large, rectangularly-shaped member, is considerably more flexible in nature than are panels 115 and 117 and may be made from a very thin sheet of chipboard (e.g., 24 pt.), cardboard, paperboard or the like. Panels 115 and 117 are laminated side-by-side onto the inside surface of backing sheet 119 (which extends the full length of panels 115 and 117), panels 115 and 117 being separated by a space used to define the spine of binder 101.

It should be understood that, although stiffener assembly 113 is shown and described herein as being constructed from three separate pieces, stiffener assembly 113 could be constructed from a unitary sheet of material which has been properly prepared, e.g., by milling, to possess the properties herein described.

Binder 101 also includes an interior surface sheet 121 and an exterior surface sheet 123. In the present embodiment, sheets 121 and 123 are made of canvas or similar fabric material but Could be made, in an alternative embodiment, of a heat-sealable thermoplastic material or the like. Sheet 123, which is rectangular in shape and is slightly larger in size than backing sheet 119, is affixed with glue (not shown) or another suitable adhesive to the exteriorly-facing surface of backing sheet 119, with its four marginal edges turned over and secured to the interiorly-facing surfaces of backing sheet 119 and stiffener panels 115 and 117. Sheet 121, which is rectangular in shape and is slightly smaller in size than backing sheet 119, is affixed with glue (not shown) or another suitable adhesive over the inturned marginal edges of sheet 123 and the remaining interiorly-facing surface of backing sheet 119 and panels 115 and 117.

Stiffener assembly 113, together with surface sheets 121 and 123, define a binder cover 131 having a front cover 133, a rear cover 135 and a flexible spine 137. Although not shown in the present embodiment, it is to be understood that the interior surfaces of front cover 133 and rear cover 135 could be finished off, if desired, with a pair of conventional paper finishing sheets.

Binder 101 further includes a conventional ring assembly 141. Ring assembly 141 is riveted to rear cover 135 adjacent to flexible spine 137 with a pair of rivets 142. As seen best in FIG. 2, when binder 101 is placed in a closed condition, spine 137 conforms to the shape of ring assembly 141.

Figure 8:
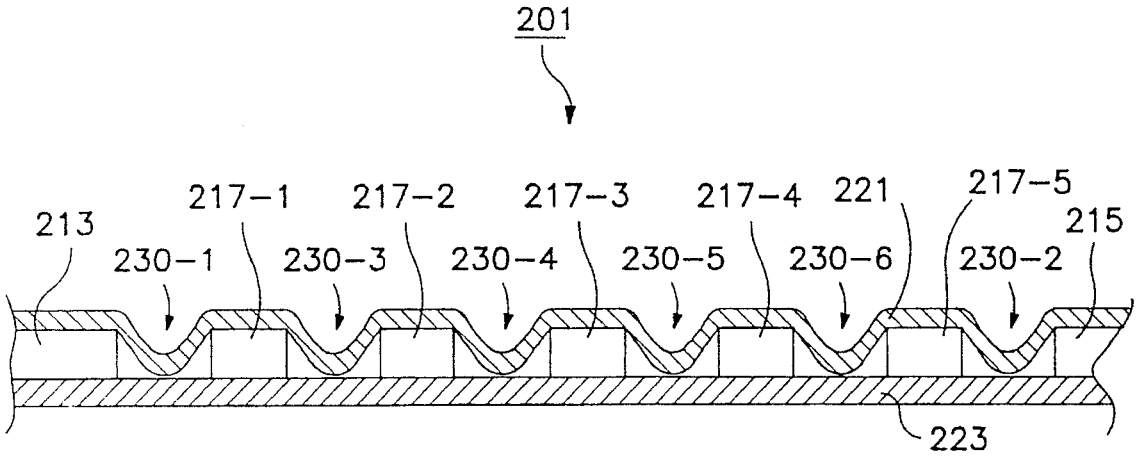
FIG. 8 is a fragmentary section view taken along line 2—2 in FIG. 6, the ring assembly not being shown for simplicity.
Figure 6:
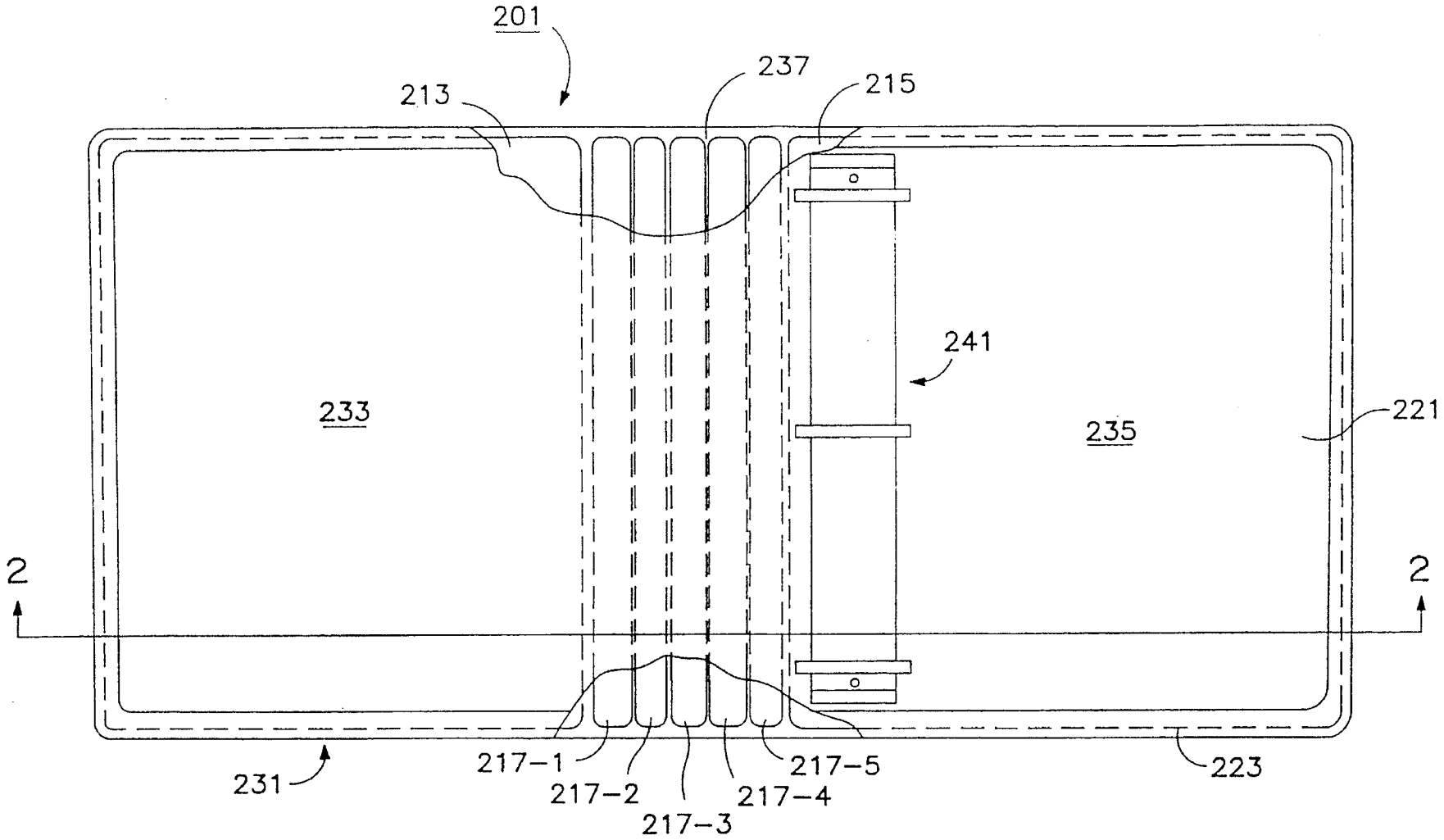
FIG. 6 is a plan view, broken away in part, of a second embodiment of a ring binder constructed according to the teachings of the present invention, the ring binder being shown in an opened condition.
Figure 7:
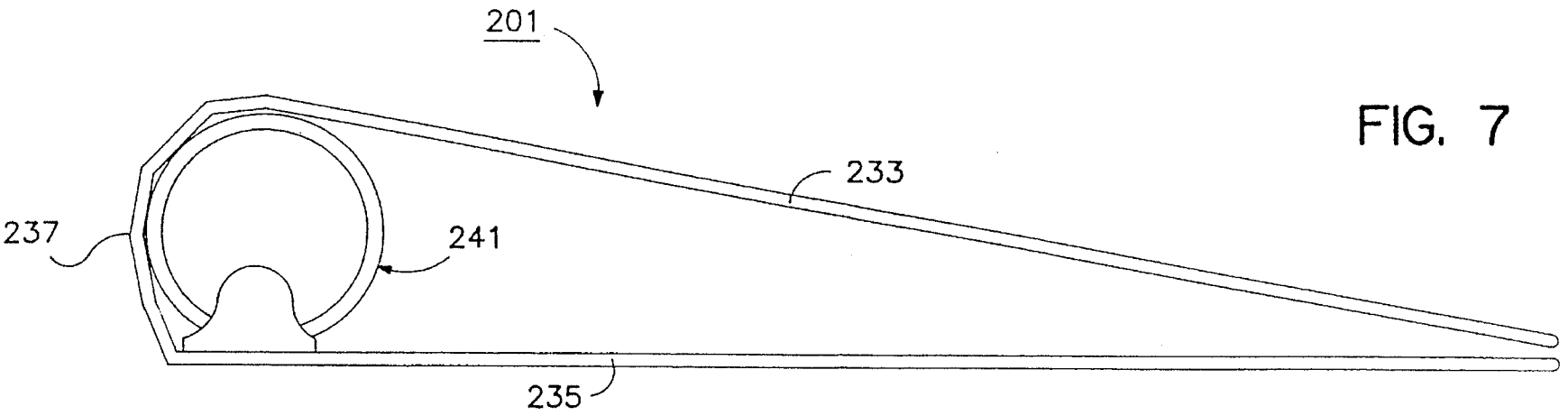
FIG. 7 is a side view of the ring binder shown in FIG. 6.

Referring now to FIGS. 6 through 8, there are shown various views of a second embodiment of a ring binder constructed according to the teachings of the present invention, the ring binder being represented generally by reference numeral 201.

Ring binder 201 includes a front cover stiffener panel 213 and a rear cover stiffener panel 215, stiffener panels 213 and 215 being spaced apart and being in parallel relation to one another. Stiffener panels 213 and 215 may be identical in size, shape and composition to stiffener panels 115 and 117, respectively, of binder 101.

Ring binder 201 also includes a plurality of identical, spaced-apart, rigid stiffener strips 217-1 through 217-5. Stiffener strips 217, which may be the same in composition and thickness as stiffener panels 213 and 215, are arranged between stiffener panels 213 and 215 in parallel relation thereto and extending the full height thereof.

It should be understood that, although in the present embodiment five stiffener strips 217-1 through 217-5 are shown, the present invention is not limited to the use of five stiffener strips and that any number of stiffener strips more than one stiffener strip may be employed in the binder of the present invention.

Ring binder 201 further includes an interior surface sheet 221 and an exterior surface sheet 223. In the present embodiment, sheets 221 and 223 are identical in size, shape and composition to sheets 121 and 123, respectively, of binder 101. In an alternative embodiment, sheets 221 and 223 could be a pair of superimposed heat-sealable thermoplastic sheets or the like. Sheet 223 is affixed with glue (not shown) or another suitable adhesive to the exteriorly-facing surfaces of panels 213 and 215 and strips 217-1 through 217-5, with the four marginal edges of sheet 223 being turned over and secured to the interiorly-facing surfaces of panels 213 and 215 and strips 217-1 through 217-5. Sheet 221 is affixed with glue (not shown) or another suitable adhesive over the inturned marginal edges of sheet 223 and the remaining interiorly-facing surfaces of panels 213 and 215 and strips 217-1 through 217-5. As seen best in FIG. 8, a pair of of completely penetrating channels 230-1 and 230-2 are formed between strip 217-1 and panel 213 and between strip 217-5 and panel 215, respectively, and a plurality of additional completely penetrating channels 230-3 through 230-6 are formed between adjacent strips 217. Sheets 221 and 223 are preferably affixed to one another with glue (not shown) or another suitable adhesive through channels 230-1 through 230-6.

Stiffener panels 213 and 215 and stiffener strips 217, together with surface sheets 221 and 223, define a binder cover 231 having a front cover 233, a rear cover 235 and a foldable spine 237. Although not shown in the present embodiment, it is to be understood that the interior surfaces of front cover 233 and rear cover 235 could be finished off, if desired, with a pair of conventional paper finishing sheets.

Binder 201 further includes a conventional ring assembly 241. Ring assembly 241 is riveted or otherwise secured to rear cover 235 adjacent to foldable spine 237. As seen best in FIG. 7, when binder 201 is placed in a closed condition, spine 237 folds conformingly around ring assembly 241.

Figure 11:
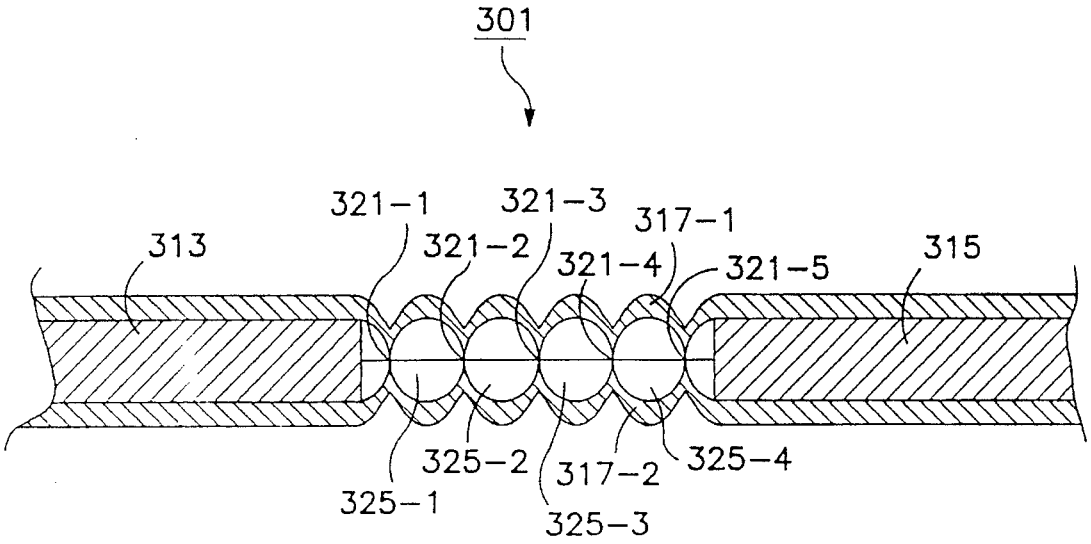
FIG. 11 is a fragmentary section view taken along line 3—3 in FIG. 9, the ring assembly not being shown for simplicity.
Figure 10:
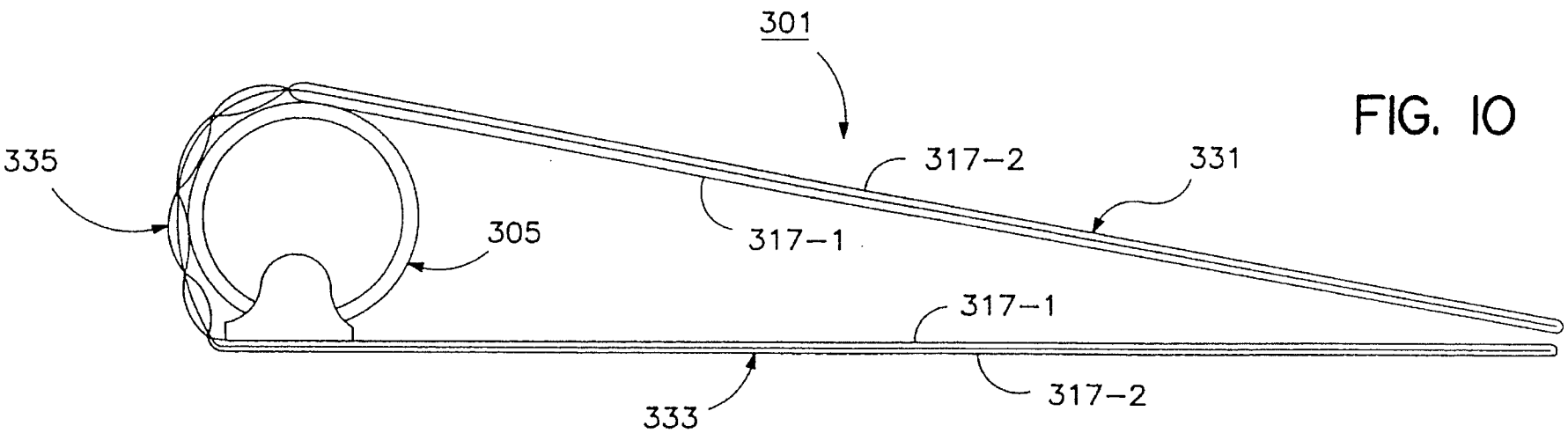
FIG. 10 is a side view of the ring binder shown in FIG. 9.
Figure 9:
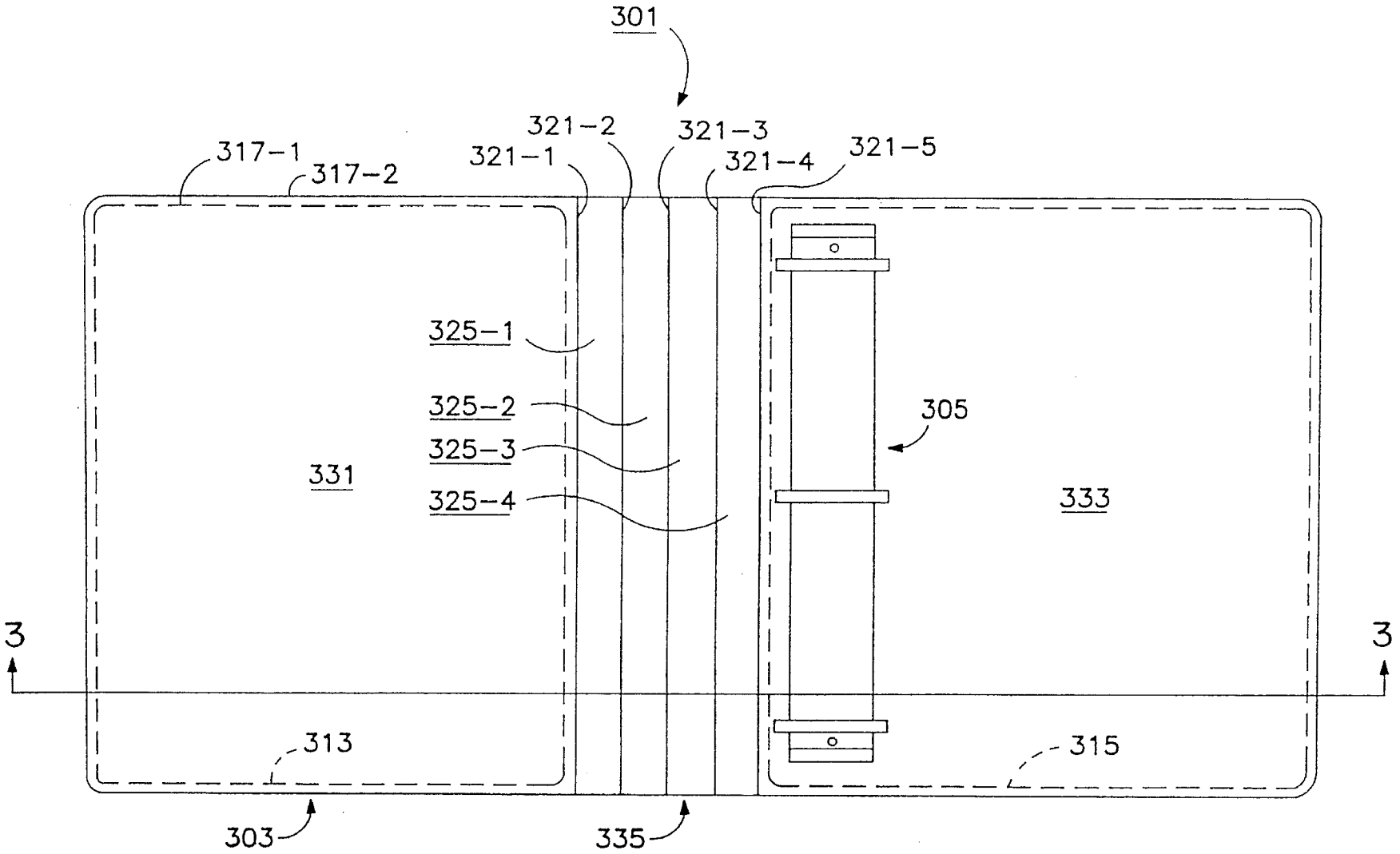
FIG. 9 is a plan view of a third embodiment of a ring binder constructed according to the teachings of the present invention, the ring binder being shown in an opened condition.

Referring now to FIGS. 9 through 11, there are shown various views of a third embodiment of a ring binder constructed according to the teachings of the present invention, the ring binder being represented generally by reference numeral 301.

Ring binder 301 includes a binder cover 303 and a ring assembly 305. Binder cover 303 includes a front cover stiffener panel 313, a rear cover stiffener panel 315 and a pair of identical heat-sealable thermoplastic sheets 317-1 and 317-2. Panels 313 and 315 may be identical in size, shape and composition to stiffener panels 115 and 117, respectively, of binder 101.

To fabricate cover 303, panels 313 and 315 are positioned between sheets 317-1 and 317-2 so that panels 313 and 315 are spaced apart from and in parallel relation to one another. Sheets 317-1 and 317-2 are then heat-sealed to one another around their respective peripheries. In addition, sheets 317-1 and 317-2 are heat-sealed to one another along a plurality of seams 321-1 through 321-5. (Although five seams are shown in the present embodiment, it is to be understood that the present invention does not require the use of five seams and that any number of seams greater than two seams may be employed in the binder of the present invention.) Seams 321-1 through 321-5, which extend the full length between opposing peripheries of sheets 317-1 and 317-2, are evenly spaced between panels 313 and 315 and are in parallel relation thereto. A plurality of inflatable chambers 325-1 through 325-4 are formed by adjacent pairs of seams 321-1 through 321-5, together with the adjacent portions of the respective peripheries of heat-sealable thermoplastic sheets 317-1 and 317-2. Chambers 325-1 through 325-4, which together form a foldable spine, are then inflated with air.

Thus fabricated, cover 303 is shaped to define a front cover 331, a rear cover 333 and a foldable spine 335. Ring assembly 305 is riveted or otherwise secured to rear cover 333 adjacent to foldable spine 335. As seen best in FIG. 10, when binder 301 is placed in a closed condition, spine 335 folds conformingly around ring assembly 305.

The embodiments of the present invention recited herein are intended to be merely exemplary and those skilled in the art will be able to make numerous variations and modifications to them without departing from the spirit of the present invention. All such variations and modifications are intended to be within the scope of the present invention as defined by the claims appended hereto.

What is claimed is:

1. A ring binder comprising:

(a) a stiffener assembly, said stiffener assembly having an interior surface and an exterior surface and comprising
  (i) a front cover stiffener panel,
  (ii) a rear cover stiffener panel, and
  (iii) a flexible backing, said front cover stiffener panel and said rear cover stiffener panel being spaced apart from one another and being interconnected by said flexible backing, said stiffener assembly being devoid of any stiffeners disposed between said front cover stiffener panel and said rear cover stiffener panel;

(b) an interior surface sheet secured to the interior surface of said stiffener assembly;

(c) an exterior surface sheet secured to and extending over the entirety of the exterior surface of said stiffener assembly; and (d) a ring assembly secured to one of said front cover stiffener panel and said rear cover stiffener panel;

(e) whereby said surface sheets and said stiffener assembly cooperatively define a binder cover having front and rear covers interconnected by a flexible spine, said flexible spine being conformable about said ring assembly.

2. The ring binder as claimed in claim 1 wherein said front cover stiffener panel and said rear cover stiffener panel are laminated onto said flexible backing.

3. The ring binder as claimed in claim 2 wherein said flexible backing extends the full length underneath said front cover stiffener panel and said rear cover stiffener panel.

4. The ring binder as claimed in claim 1 wherein said exterior surface sheet is of canvas material.

5. The ring binder as claimed in claim 1 wherein said interior surface sheet and said exterior surface sheet are of canvas material.

6. The ring binder as claimed in claim 1 wherein said ring assembly is secured to said rear cover stiffener panel.

7. The ring binder as claimed in claim 1 wherein said exterior surface sheet is generally rectangular in shape and has four marginal edges, said exterior surface sheet being secured to the exterior surface of said stiffener assembly with said four marginal edges being turned over said stiffener assembly and secured to the interior surface of said stiffener assembly.

8. The ring binder as claimed in claim 7 wherein said interior surface sheet is secured to said four turned-over marginal edges of said exterior surface sheet.

9. A ring binder comprising:

(a) an inside surface sheet;

(b) an outside surface sheet;

(c) a front cover stiffener panel, said front cover stiffener panel being secured between said inside and said outside surface sheets;

(d) a rear cover stiffener panel, said rear cover stiffener panel being spaced apart from said front cover stiffener panel in parallel relation thereto and being secured between said inside and said outside surface sheets;

(e) a plurality of stiffener strips, said stiffener strips being spaced apart and positioned between said front and rear cover stiffener panels in parallel relation thereto, said stiffener strips being secured between said inside and said outside surface sheets and forming at least one completely penetrating channel extending transversely between said inside and said outside surface sheets; and (f) a ring assembly secured to one of said from cover stiffener panel and said rear cover stiffener panel;

(g) whereby said inside and said outside surface sheets, said front and said rear cover stiffener panels, and said stiffener strips cooperatively define a binder cover having front and rear covers interconnected by a foldable spine, said foldable spine being conformable about said ring assembly.

10. The ring binder as claimed in claim 9 wherein additional completely penetrating channels are formed between said stiffener strips and said front cover stiffener panel and between said stiffener strip and said rear cover stiffener panel.

11. The ring binder as claimed in claim 9 wherein said stiffener strips are five in number, said stiffener strips forming therebetween four completely penetrating channels, said stiffener strips also forming with said front cover stiffener panel a fifth completely penetrating channel and further forming with said rear cover stiffener panel a sixth completely penetrating channel.

12. The ring binder as claimed in claim 9 wherein said outside surface sheet is of canvas material.

13. The ring binder as claimed in claim 9 wherein said inside and outside surface sheets are of canvas material.

14. The ring binder as claimed in claim 9 wherein said ring assembly is secured to said rear cover stiffener panel.

15. A ring binder comprising:

(a) a front cover stiffener panel;

(b) a rear cover stiffener panel, said rear cover stiffener panel being spaced apart from said front cover stiffener panel in parallel relation thereto;

(c) a pair of heat-sealable thermoplastic sheets, said heat-sealable thermoplastic sheets being disposed on opposite sides of said front and rear cover stiffener panels and being heat-sealed to one another around their respective peripheries and along at least three Seams extending between opposing peripheries of said heat-sealable thermoplastic sheets and located between said front and rear cover stiffener panels and in parallel relation thereto, each adjacent pair of said seams together with the adjacent portions of the respective peripheries of said heat-sealable thermoplastic sheets forming a chamber, each of said chambers being inflated with air; and (d) a ring assembly secured to one of said front cover stiffener panel and said rear cover stiffener panel;

(e) whereby said heat-sealable thermoplastic sheets and said front and said rear cover stiffener panels cooperatively define a binder cover having front and rear covers interconnected by a foldable spine comprising said inflated chambers, said foldable spine being conformable about said ring assembly.

16. The ring binder as claimed in claim 15 wherein said ring assembly is secured to said rear cover stiffener panel.

* * * * *